US005975793A

United States Patent [19]

Simmons, Jr. et al.

[11] Patent Number: 5,975,793

[45] Date of Patent: Nov. 2, 1999

[54] INTERLOCKING MEDIAN BARRIER

[75] Inventors: Roy D. Simmons, Jr., Dayton; Michael L. Budd, Sr., Bridgewater, both of Va.

[73] Assignee: Conmat Group, Inc., Harrisonburg, Va.

[21] Appl. No.: 08/969,018

[22] Filed: Nov. 12, 1997

[51] Int. Cl.[6] ..... E01F 13/02; E01F 15/08

[52] U.S. Cl. ..... 404/6; 404/7; 404/70; 249/2; 249/4

[58] Field of Search ..... 256/1, 13.1; 404/6, 404/7, 8, 9, 70, 134, 135, 72; 249/2, 4

[56] References Cited

U.S. PATENT DOCUMENTS

| | | | |
|---|---|---|---|
| 3,636,829 | 1/1972 | Palmer | 404/7 |
| 3,980,279 | 9/1976 | Bofinger . | |
| 4,059,362 | 11/1977 | Smith . | |
| 4,681,302 | 7/1987 | Thompson . | |
| 4,964,750 | 10/1990 | House et al. | 404/6 |
| 5,046,884 | 9/1991 | Girotti | 404/6 |
| 5,123,773 | 6/1992 | Yodock . | |
| 5,149,224 | 9/1992 | Smith | 404/9 X |
| 5,453,916 | 9/1995 | Tennis et al. | 404/6 X |
| 5,464,306 | 11/1995 | Cristiano . | |
| 5,471,811 | 12/1995 | House et al. . | |
| 5,558,470 | 9/1996 | Elmore et al. . | |
| 5,605,413 | 2/1997 | Brown . | |

OTHER PUBLICATIONS

Easi–Set® Industries Advertising Brochure for "J–J Hooks™", 2 pages.

*Primary Examiner*—James A. Lisehora
*Attorney, Agent, or Firm*—Nixon & Vanderhye P.C.

[57] ABSTRACT

Disclosed is a non-loose hardware type traffic separating median barrier comprising having a male interlocking structure on one end and a female interlocking structure on the other end. In a preferred embodiment, the male interlocking structure comprises a "T" section extending from the end of the barrier and the female interlocking structure comprises a vertically extending steel tube with a slot in the external portion thereof. The "T" section of one barrier can be vertically engaged with the slot and tube section of an adjacent barrier so as to interlock the barriers together. In a preferred embodiment, reinforcing bars lock the interlocking structures into their respective barriers and, in a further preferred embodiment, reinforcing bar serves to interlock the male and female interlocking structures of a single barrier.

9 Claims, 2 Drawing Sheets

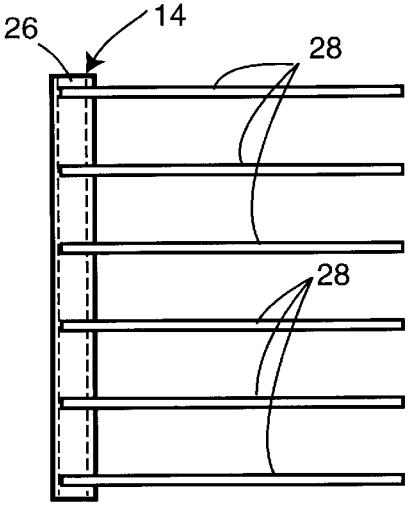
Fig.3(a)
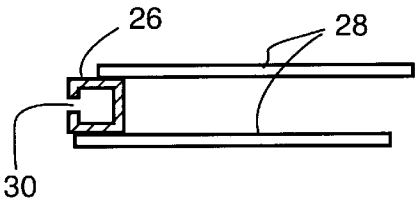
Fig.3(b)
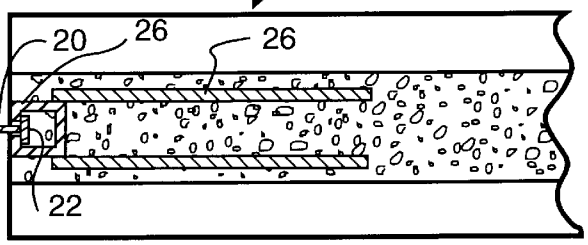
Fig.5
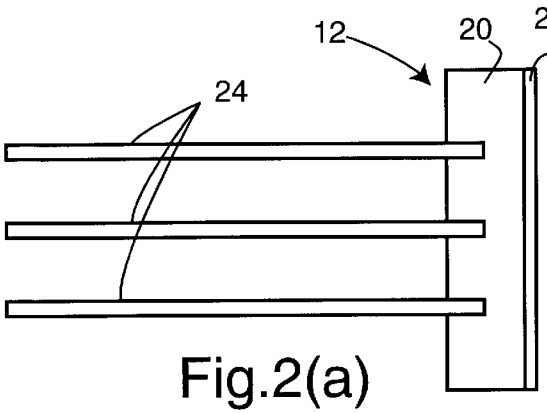
Fig.2(a)
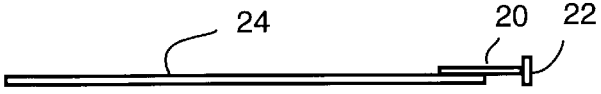
Fig.2(b)
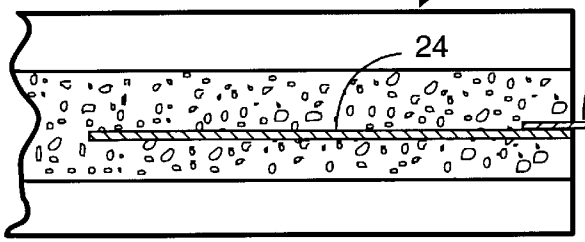

INTERLOCKING MEDIAN BARRIER

BACKGROUND OF THE INVENTION

1. Field of the Invention

The above invention relates, generally, to median barriers and, specifically, to an improved interlocking median barrier for use in highway systems.

2. Discussion of the Prior Art

Median barriers—generally relatively heavy concrete devices—are utilized for separating lanes of traffic from other lanes of traffic, construction work, etc. The barriers must be sufficiently heavy such that, if accidentally contacted by a moving vehicle, they will prevent the moving vehicle's from leaving its lane, thereby protecting construction workers or other lanes of traffic on the other side of the median barrier.

The widespread use of pre-cast reinforced concrete in median barriers is well known. However, as highway speeds have increased and as vehicle weight increases, the kinetic energy, which can be expended against a median barrier, has increased dramatically (the kinetic energy is linearly related to the weight of the vehicle but as the square of the vehicle's speed). There is an increasing need to insure that vehicles cannot pass through or substantially move a median barrier and thereby create a hazard to the adjacent lane of traffic or constructions workers or the like.

Median barriers have certain resistance to movement caused by the weight of the barrier and the coefficient of friction between the lower surface of the barrier and the roadway upon which the barrier is located. Because this coefficient of friction is generally fixed, the resistance to lateral movement is generally proportional to the weight of the barrier. For the convenience of construction crews, temporary barriers are on the order of 12 feet in length, although longer or shorter barriers could be provided if the need arose (if, for example, it were necessary to have barriers around a very sharp curve, shorter barriers would permit the outer edge of the curve to be lined with barriers without the barriers intruding on the roadway. Unfortunately, as a barrier becomes smaller, its weight is less and, thus, its resistance to lateral movement is less.

One answer to the problem of barriers being shifted under vehicle impact is to involve the weight and mass of adjacent barriers such that several adjacent barriers must be moved in the event of a vehicle impact thereby providing greater resistance to lateral movement. U.S. Pat. No. 4,059,362 issued to Smith on Nov. 22, 1977 illustrates a pre-cast reinforced concrete barrier with a vertical tongue-and-groove arrangement molded into the ends of the barrier. The tapered aspect of the tongue-and-groove arrangement allows a barrier to be placed adjacent another barrier with the tongue of one barrier engaged with the groove of another barrier thereby preventing lateral movement of one barrier with respect to the other.

In the event of a vehicle collision, the resistance to lateral movement is not only the resistance of that barrier which is struck but also, because of the tongue-and-groove arrangement, the lateral resistance of the adjacent barriers as well. A problem associated with these tongue-and-groove barriers is that only a small amount of lateral movement is necessary before the tongue-and-groove arrangement is out of alignment and the barrier involved in the collision is no longer restrained by adjacent barriers.

Attempts have been made to fix barriers together and/or pin them to the road surface to increase the lateral resistance to movement of roadway barriers. U.S. Pat. No. 4,681,302 issued to Thompson on Jul. 21, 1987 illustrates a loose hardware type barrier which has end fittings which align with the end fittings of adjacent barriers. A separate piece of hardware, a locking pin, is inserted and then driven into the roadway. While this permits secure interlocking of the barrier and the roadway, experience has shown that such interlocked loose hardware barriers are extremely difficult to replace and/or repair.

Even if the locking pin can be removed from the roadway surface and from the interlocking mechanism, because the remaining portion of the interlocking mechanism of one barrier is vertically interrelated with an adjacent barrier, the barrier cannot simply be raised out of place and a new barrier substituted. The barrier has to be slid sideways for some distance and then removed creating substantial difficulties in replacement. Furthermore and more importantly, in the event of an accident in which the barrier is struck with a large vehicle (in the case of a concrete truck or a semi-tractor trailer vehicle), the barrier may be badly broken with the interlocking pins of adjacent barriers bent under the impact. It will be impossible to remove the pins. This difficulty makes it extremely costly (in terms of time, expense and public inconvenience due to the time for replacement) in the event of an accident.

U.S. Pat. No. 5,464,306 issued to Cristiano on Nov. 7, 1995 is a suggested answer to the above barrier problems. A male protrusion built into the end of one barrier interlocks with a diagonal female protrusion on the end of another barrier so as to retain the barriers in an interlocked fashion in the event of a vehicle collision. However, should the barrier be damaged in the collision, it can readily be hoisted vertically and replaced with a similar barrier. However, there are some difficulties with the Cristiano system. Cristiano utilizes a hollow area in the bottom of the barrier and thus the female portion extends only from the top of the barrier to a lower portion of the barrier but not vertically over the complete height of the barrier. This tends to reduce the area of the interlocking structure thereby increasing the stress on the interlocking mechanism. Furthermore, the Cristiano interlocking mechanism, as seen in FIG. 5, comprises a diagonal tube in which one corner of the tube is removed. It can be seen that very little longitudinal stress would be necessary for the male portion 3 to effectively straighten out the outer two arms of the diagonal 9 and 12 under tensile forces. Accordingly, these deficiencies reduce the ability of a barrier under impact load to transmit the load to adjacent barriers and thereby use the lateral movement resistance of adjacent barriers to stabilize the barrier.

The Federal Highway administration, recognizing defects existing in current interlocked median barriers, published a research paper (Publication No. FHWA-TS-88-006) in which weaknesses of many concrete barrier connectors are disclosed (pages 7–8, 73–74). The FHWA study (page 69) indicated that "unanchored pins in pin and loop connectors have a tendency to 'jump out' of loops during vehicle impact, thereby destroying the integrity of the connection." This study also discloses the weakness of dowel type and tongue-and-groove type connectors with respect to requiring movement and repositioning of adjoining barriers to free up a damaged unit so that a new unit can be installed.

SUMMARY OF THE INVENTION

In view of the above, it is an object of the present invention to provide a traffic median barrier having an improved interlocking mechanism.

It is a further object of the present invention to provide a traffic median barrier having an interlocking structures on each end of the barrier where the barrier can be interlocked with an adjacent barrier.

It is a still further object of the present invention to provide an interlocking median barrier where the interlocking structure at each end of the barrier is structurally interconnected throughout the length of the barrier.

It is an additional object of the present invention to provide an interlocking median barrier which does not require any unattached loose hardware to complete the interlocking process.

The above and other objects are achieved by utilizing a rectangular tube cast into one end of the barrier where the tube has a vertically oriented slot therein. On the other end of the barrier, a male interlocking structure comprising a vertically extending web having a thickness less than the slot and having a second web on the end of the first web which has a greater width than the slot so that when interconnected, the male interconnecting structure cannot be pulled through the slot even under impact loads.

In a preferred embodiment, the female interlocking structure has a square cross-section and the male interlocking structure has a "T" shape. The interlocking structures on either ends of a barrier can be interconnected by reinforcing steel which is embedded in the structure of the pre-cast concrete barrier.

BRIEF DESCRIPTION OF THE DRAWINGS

The present invention will be more clearly understood by reference to the following drawings in which FIG. 1(*a*) is a side view of a barrier in accordance with the present invention;

FIG. 1 (*c*) is a end view of the barrier shown in FIG. 1(*a*) showing the female interlocking structure in accordance with the present invention;

FIGS. 2(*a*) and 2(*b*) show side and plan views, respectively, of the male interlocking structure of the present invention;

FIGS. 3(*a*) and 3(*b*) show side and plan views of the female interlocking structure in accordance with the present invention;

FIG. 5 is a plan cross-sectional view showing the male interlocking structure of one barrier interlocked with the female interlocking structure of an adjacent barrier in accordance with the present invention.

DETAILED DESCRIPTION OF PREFERRED EMBODIMENTS

Figure 4B:
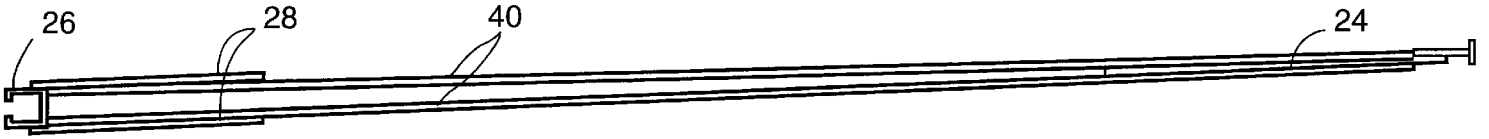
FIGS. 4(*a*) and 4(*b*) show side and plan views, respectively, of the male and female interlocking structures and the interconnecting structure between the male and female interlocking structures.

The similar structures are similarly numbered among the various figures in the drawings.

Figure 1B:
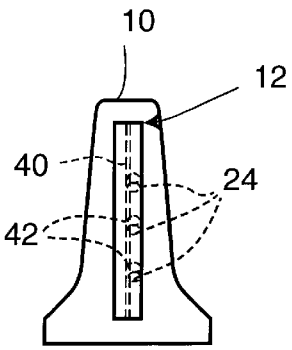
FIG. 1(*b*) is an end view of the barrier shown in FIG. 1(*a*) illustrating the male interlocking structure in accordance with the present invention.
Figure 1A:
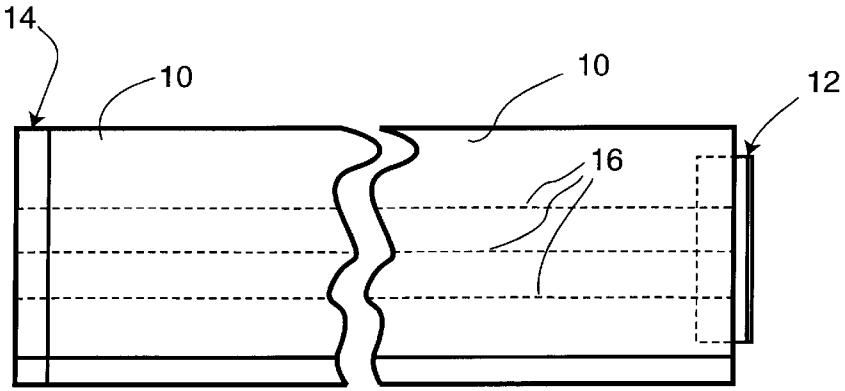
Figure 1C:
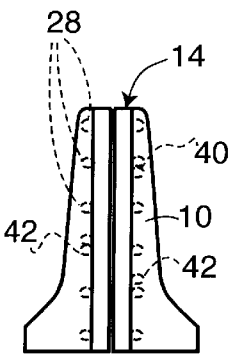

FIG. 1(*a*) is a side view of a precast concrete barrier 10 in accordance with the present invention. FIG. 1(*b*) is an end view of the male interlocking structure 12 on one end of barrier 10. FIG. 1(*c*) is an end view of the other end of the barrier in FIG. 1(*a*) showing the female interlocking structure 14 located thereon. Depicted in phantom lines are a connection structure for interconnecting the male interlocking structure 12 with the female interlocking structure 14 internal to the barrier 10.

The barrier 10 is constructed of reinforced concrete having a minimum compressive strength at the age of 28 days of 4,000 psi. All reinforcement in the barrier conforms to ASTM A615, Grade 60. Preferably, the standard length for a barrier section is about 12 feet with the male portion protruding from the end of the barrier by about 1 ⅞ inches. The width of the base of the barrier shown in FIGS. 1(*b*) and 1(*c*) is preferably about 23.6 inches and the height about 31.8 inches. Should a length less than about 12 feet be desirable, such length can be cast directly. Should a section longer than 12 feet be needed, it is preferred that such a length be cast in two or more units.

FIGS. 2(*a*) and 2(*b*) show the details of a preferred embodiment of the male interlocking structure 12 comprising first and second webs 20 and 22, respectively. In a preferred embodiment, the first web extends vertically at least 2 feet and is 6 inches wide. The second web extends along the length of the first web 20 and is approximately 2 inches wide. The first web 20 is welded to the second web 22 to form a "T" shape (although it could be forged in one piece).

Welded to the first web 20 are a number of reinforcing bars 24 which serve to aid in anchoring the first web 20 in the end of concrete barrier 10. Unless otherwise specified, all reinforcing bar disclosed in the preferred embodiments of the present invention are number 6 A706 rebar. In the embodiment shown in FIGS. 2(*a*) and 2(*b*), the rebar is at least 3 feet long and welded to the first web where it is in contact therewith. Each of the webs is one-half inch thick structural steel and can be standard steel, i.e., A36 (FYE close 36 ksi) or in a preferred embodiment, high strength structural steel A500 (FYE close 39 ksi).

The female interlocking structure 14 is a rectangular tube 26 which, in a preferred embodiment, is structural steel tubing one-half inch thick and 4 inches square extending the full height of the barrier. The axis of the rectangular tube is orthogonal with the longitudinal extending direction of the barrier. Parallel with the longitudinally extending direction of the barrier and affixed and welded to the sides of the substantially vertically oriented steel tube 26 are two foot long sections of reinforcing bar 28 welded thereto. Again, the reinforcing bar serves to anchor the structural tube 26 in the reinforced concrete of the median barrier. In the portion of the steel tube 26 external to the median barrier is a vertically extending slot 30 which has a width greater than the thickness of first web 20 and in a preferred embodiment is equal to one inch.

The interrelationship of the male interlocking structure and the female interlocking structure with a respective barrier 10 is shown in FIG. 5. As can be seen, either the male end of the leftmost barrier or the female end of the right-hand barrier can be lowered vertically so as to interengage the first and second webs of the male interlocking structure with the slot and structural tube of the female interlocking structure. As shown, in a preferred embodiment, there is a gap of 1 inch separation when the barriers are pulled as far apart as possible while in the interconnected state. This permits one barrier to be canted slighted with respect to another so as to permit a curve in a line of barriers without disengaging the interlocking portions of the barriers. Furthermore, the barriers continue to form a structural interconnection between adjacent barriers when forming a curve or other complex pattern along the roadway. This spacing also permits barriers to be interengaged when there is a vertical displacement, i.e., the line of barriers begins to go up or over a hill.

Figure 4A:
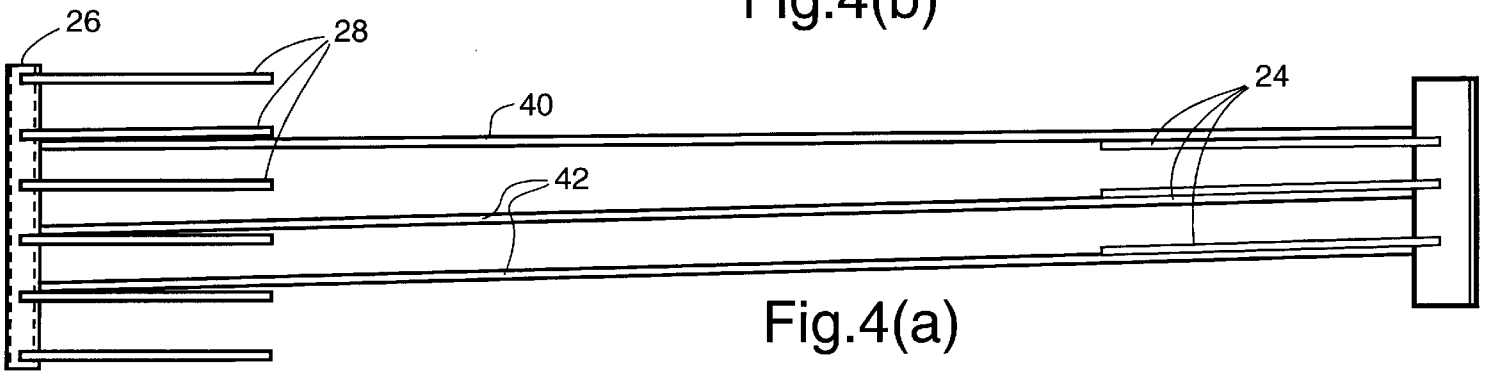

While, the 3 foot rebar sections on the male interlocking structure 12 and the 2 foot rebar sections on the female interlocking structure 14 securely anchor the respective structures in the reinforced concrete barrier, in a preferred embodiment the male and female interlocking structures are interconnected internally to the barrier. FIGS. 4(*a*) and 4(*b*) show these interlocking structures. Reinforcing bars 40 and 42 on the upper and lower portions of the median barrier comprises in a preferred embodiment an 11 foot 8 inch section of number 5 rebar.

These interconnecting reinforcing bars 40 and 42 may be welded to the reinforcing bars 24 and 28 of the male and female interlocking structure, respectively. In a preferred embodiment which facilitates casting of the median barrier, the interconnecting rebar 40 and 42 is merely wired to be adjacent the corresponding reinforcing bars 24 and 28 as shown in the phantom lines of FIGS. 1(*b*) and 1(*c*). This facilitates precise alignment of the male and female interlocking structures while the concrete is poured and cured. It is noted that the overlap in which the interconnecting reinforcing bars 40 and 42 coextend with the male and female reinforcing bar sections is preferably equal to 40 diameters of the larger reinforcing bar which by definition provides the same structural strength as welding.

Median barriers constructed in accordance with the preferred embodiment disclosed above have met or exceeded, in independent crash tests, the new Federal Highway Administration standards for median barriers. These tests were conducted by the Texas Transportation Institute in January and June 1997 and confirm that barriers did not separate even though impacted by a 2.205 ton pickup traveling at 63.3 miles per hour at a 25.66 incidence angle with the barrier.

The Federal Highway Administration approval of barrier in accordance with the above design was granted on Oct. 20, 1997. This is the only non loose hardware barrier which has been approved in accordance with latest Federal Highway Administration standards.

In view of the above, persons of ordinary skill in the art in the median barrier construction field will note many modifications and changes which can be made to the presently disclosed invention. For example, reinforcing bars could be mechanically connected, i.e., through U-shaped bolts or extending through holes in the structural tube and/or first web to aid in connecting the interlocking components to their respective ends of the pre-cast concrete median barrier. Different numbers of reinforcing bars and different sizes of bars could be used in order to maintain a secure connection between the interlocking structures and their respective barriers.

Different arrangements of webs could be used as long as the first web can be inserted vertically into the slots of the female interlocking structure and the second web is wider than the slot so as to prevent disengagement in any direction other than a vertical direction. Accordingly, the above invention is limited only by the limitations contained in the claims appended hereto and are not limited to the preferred embodiment and examples thereof disclosed in the specification.

What is claimed is:

1. A traffic separating median barrier, said barrier capable of positively interlocking with another similar median barrier and thereby being incapable of separation from a similar median barrier when interlocked therewith under a vehicle impact load sufficient to otherwise move a similar but non-interlocked median barrier, said barrier comprising:

a barrier base comprised of an elongated concrete material, said barrier base having a substantially uniform cross section along a longitudinal extending direction and terminating in two ends, each barrier end having a positive interlocking structure, said positive interlocking structure comprising a male interlocking structure on one end of said barrier and a female interlocking structure on the other end of said barrier:

said female interlocking structure comprising a substantially vertically extending rectangular tube where an axis of the tube is orthogonal with respect to said longitudinal extending direction, said female interlocking structure is connected to said barrier base and including a substantially vertically extending slot having a width in a substantially horizontal direction;

said male interlocking structure comprising at least one first web having a thickness less than said slot, said at least one first web longitudinally extending from said barrier end and terminating in at least one second web having a width in a substantially horizontal direction greater than said width of said slot, wherein said male interlocking structure is connected to said barrier base, wherein the male interlocking structure of the median barrier is interlocked with the female interlocking structure of an adjacent similar barrier when said first web of one barrier extends through said slot of a second barrier and said second web of said one barrier is located within said metal tube of said second barrier, wherein both said male and female interlocking structures are comprised of metal; and at least one length of concrete reinforcing rod interconnected to each of said interlocking structures and extending longitudinally into said concrete barrier, further including an additional interconnecting concrete reinforcing rod extending between and overlapping said at least one concrete reinforcing rod interconnected with said male interlocking structure and at least one concrete reinforcing rod interconnected with said female interlocking structure, wherein said interconnecting concrete reinforcing rod overlaps each of said reinforcing rods interconnected with said male and female interlocking structures by a distance of at least 40 diameters of said interconnecting concrete reinforcing rod.

2. A traffic separating median barrier according to claim 1, wherein said concrete is precast concrete and said tube is at least partially embedded in said pre-cast concrete.

3. A traffic separating median barrier according to claim 2, wherein said pre-cast concrete material is reinforced concrete.

4. A traffic separating median barrier according to claim 1, wherein each of said at least one first web and said at least one second web are single substantially vertically extending webs interconnected to form a T-shape in horizontal cross section.

5. A traffic separating median barrier according to claim 4, wherein said male interlocking structure extends from above a lower extremity of said barrier base to below an upper extremity of said barrier base.

6. A traffic separating median barrier according to claim 5, wherein said first web extends longitudinally a sufficient amount so that, when interlocked with a similar barrier, there is a space between the adjacent ends of the barriers.

7. A traffic separating median barrier according to claim 1, wherein said concrete reinforcing rods are steel reinforcing rods.

8. A traffic separating median barrier according to claim 1, wherein said female interlocking structure extends from a lower extremity of said barrier base to an upper extremity of said barrier base.

9. A method of constructing a concrete median barrier comprising the steps of (a) providing male and female interlocking structures;

(b) welding to each of said male and female interlocking structures, at least one length of concrete reinforcing bar extending in a longitudinal direction for said concrete median barrier;

(c) locating said male and female interlocking structures in a form into which concrete may be poured;

(d) providing at least one length of interconnecting reinforcing bar overlapping at least a portion of said reinforcing bars welded to said male and female interlocking sections;

(e) wire tying said at least one interconnecting bar to said respective longitudinally extending reinforcing bars welded to said male and female interlocking structures;

(f) pouring concrete into said form sufficient to fill it to the desired median barrier shape, permitting sufficient curing time and removing the barrier from said form.

* * * * *